US006611088B2

(12) United States Patent
Song et al.

(10) Patent No.: US 6,611,088 B2
(45) Date of Patent: Aug. 26, 2003

(54) TENSION MASK FRAME ASSEMBLY FOR COLOR CRT

(75) Inventors: Gi-young Song, Suwon (KR); Soon-cheol Shin, Suwon (KR); Il-hwan Jang, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 174 days.

(21) Appl. No.: 09/780,482

(22) Filed: Feb. 12, 2001

(65) Prior Publication Data

US 2001/0013750 A1 Aug. 16, 2001

(30) Foreign Application Priority Data

Feb. 11, 2000 (KR) ..... 00-6542

(51) Int. Cl.[7] ..... H01J 29/80
(52) U.S. Cl. ..... 313/407; 313/402
(58) Field of Search ..... 313/407, 402

(56) References Cited

U.S. PATENT DOCUMENTS

| | | | | |
|---|---|---|---|---|
| 4,605,879 A | | 8/1986 | Rath | 313/407 |
| 4,798,992 A | | 1/1989 | Ichigaya et al. | 313/406 |
| 4,847,532 A | | 7/1989 | Rath | 313/407 |
| 4,973,283 A | * | 11/1990 | Adler et al. | 445/30 |
| 5,289,080 A | | 2/1994 | Park | 313/402 |
| 5,451,833 A | | 9/1995 | Tong | 313/402 |
| 5,523,647 A | * | 6/1996 | Kawamura et al. | 313/407 |
| 5,698,938 A | | 12/1997 | Kim et al. | 313/407 |
| 5,932,957 A | * | 8/1999 | Ragland, Jr. | 313/402 |
| 5,949,183 A | | 9/1999 | Saita et al. | 313/407 |
| 6,054,803 A | | 4/2000 | Saita | 313/402 |

* cited by examiner

*Primary Examiner*—Quana M. Grainger
(74) *Attorney, Agent, or Firm*—Robert E. Bushnell, Esq.

(57) ABSTRACT

A tension mask frame assembly for a color cathode-ray tube includes a frame including first and second support members, and at least a pair of elastic members supporting the first and second support members, both end portions of each of the elastic members are secured to the first and second support members, a tension mask including a plurality of strips and forming slits, a plurality of tie bars disposed between the strips and connecting neighboring strips to divide slits, where longer side portions perpendicular to a lengthwise direction of the strips are secured to the first and second support members, and vibration prevention members having both end portions supported at the first and second support members, having a predetermined tensile force, and being in contact with shorter side portions of the tension mask in a direction parallel to the strips of the tension mask.

19 Claims, 6 Drawing Sheets

TENSION MASK FRAME ASSEMBLY FOR COLOR CRT

CLAIM OF PRIORITY

This application makes reference to, incorporates the same herein, and claims all benefits accruing under 35 U.S.C. §119 from an application entitled Tension Mask and Frame Assembly for Color Cathode Ray Tube earlier filed in the Korean Industrial Property Office on Feb. 11, 2000, and there duly assigned Serial No. 2000-6542 by that Office.

BACKGROUND OF THE INVENTION

1. Field of the Invention

The present invention relates to a color cathode-ray tube (CRT), and particularly, to a tension mask frame assembly for a cathode-ray tube that can reduce vibrations of a tension mask supported by a frame.

2. Description of the Background Art

In a color cathode-ray tube, three electron beams emitted from an electron gun pass through electron beam passing holes of a shadow mask having a color selection function. The electron gun is installed on a neck portion of a funnel. Then, the beams land on a fluorescent film formed on the inner surface of a panel which is coupled to the funnel forming a seal. The fluorescent film is coated with red, green and blue fluorescent substances and the fluorescent substances are excited by the incident beams, forming an image.

The above color cathode-ray tube needs to have a flat screen surface so that a viewing angle for a viewer can be wider and distortion of an image can be prevented. Accordingly, the mask installed inside the cathode-ray tube and having a color selection function should have a flat surface. However, such a flat mask is one of many obstacles in manufacturing a complete flat cathode-ray tube.

A tension mask frame assembly includes a frame and a flat type tension mask. The flat type tension mask has two long sides welded to the frame. A plurality of slits are formed in strips on the tension mask.

In the tension mask frame assembly having the above structure, since only the longer sides of the tension mask are secured to the frame, the shorter sides of the tension mask are free to vibrate in directions perpendicular to the surfaces of the tension mask. Thus, even a small impact applied from the outside can vibrate the tension mask supported by the frame. Such vibrations of the tension mask prohibit electron beams emitted from an electron gun from accurately passing through the slits. Accordingly, the paths of the electron beams having passed through the slits change so that an error in landing on each of portions of a fluorescent film is generated. As a result, an image displayed on a screen of the cathode-ray tube vibrates according to the vibrations of the tension mask so that the quality of the image deteriorates.

Exemplars of the art are U.S. Pat. No. 5,289,080 issued to Park for Mask Frame Damper for Color Cathode Ray Tubes, U.S. Pat. No. 6,054,803 issued to Saita for Color Selecting Mechanism for a CRT Having Specified Aperture Slit Dimensional Relationships in Order to Dampen Vibrations, U.S. Pat. No. 5,451,833 issued to Tong for Shadow Mask Damping for Color CRT, U.S. Pat. No. 5,598,938 issued to Kim et al for Frame Structure for a Cathode-Ray Tube, U.S. Pat. No. 4,798,992 issued to Ichigaya et al. for Color Cathode-Ray Tube with Electron Beam Selection Mask Support Structure, U.S. Pat. No. 5,949,183 issued to Saita et al. for Color Selecting Mechanism of Cathode-Ray Tube and Color Selecting Mechanism Frame Thereof, U.S. Pat. No. 4,605,879 issued to Rath for Rigid CRT Shadow Mask Assembly, and U.S. Pat. No. 4,847,532 issued to Rath for Tensed Shadow Mask Assembly for Cathode-Ray Tube.

SUMMARY OF THE INVENTION

It is therefore an object of the present invention to provide a tension mask frame assembly for a cathode-ray tube that prevents the tension mask supported at the frame from vibrating by an external impact so that deterioration of the quality of an image due to vibrations of the image can be prevented.

It is another object to have a mask in an electron beam apparatus that is stable and avoids vibrations that affect picture quality.

It is yet another object to have a tension mask that is easy to assemble and manufacture while still reducing the affects of vibration upon an image generated by the cathode-ray tube.

It is still yet another object to have a tension mask assembly that is inexpensive to manufacture and yet reduces the vibration on the tension mask that deteriorates the quality of an image.

Accordingly, to achieve the above objectives, there is provided a tension mask frame assembly for a color cathode-ray tube having a frame including first and second support members separated a predetermined distance from each other, and at least a pair of elastic members for supporting the first and second support members, both end portions of each of the elastic members are secured to the first and second support members, a tension mask including a plurality of strips separated a predetermined distance from each other and forming slits, a plurality of tie bars disposed between the strips and connecting neighboring strips to divide slits, where longer side portions perpendicular to a lengthwise direction of the strips are secured to the first and second support members so that a tensile force is applied to the strips, and vibration prevention members having both end portions supported at the first and second support members, having a predetermined tensile force, and being in contact with shorter side portions of the tension mask in a direction parallel to the strips of the tension mask.

It is preferred in the present invention that the vibration prevention members are formed of bands having a predetermined width and thickness, and that the bands are provided with a plurality of contact means facilitating contact with the edge of the shorter side portion of the tension mask.

Dummy bridges extending from the neighboring strips in the corresponding directions are formed between the strips connected by the tie bar.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
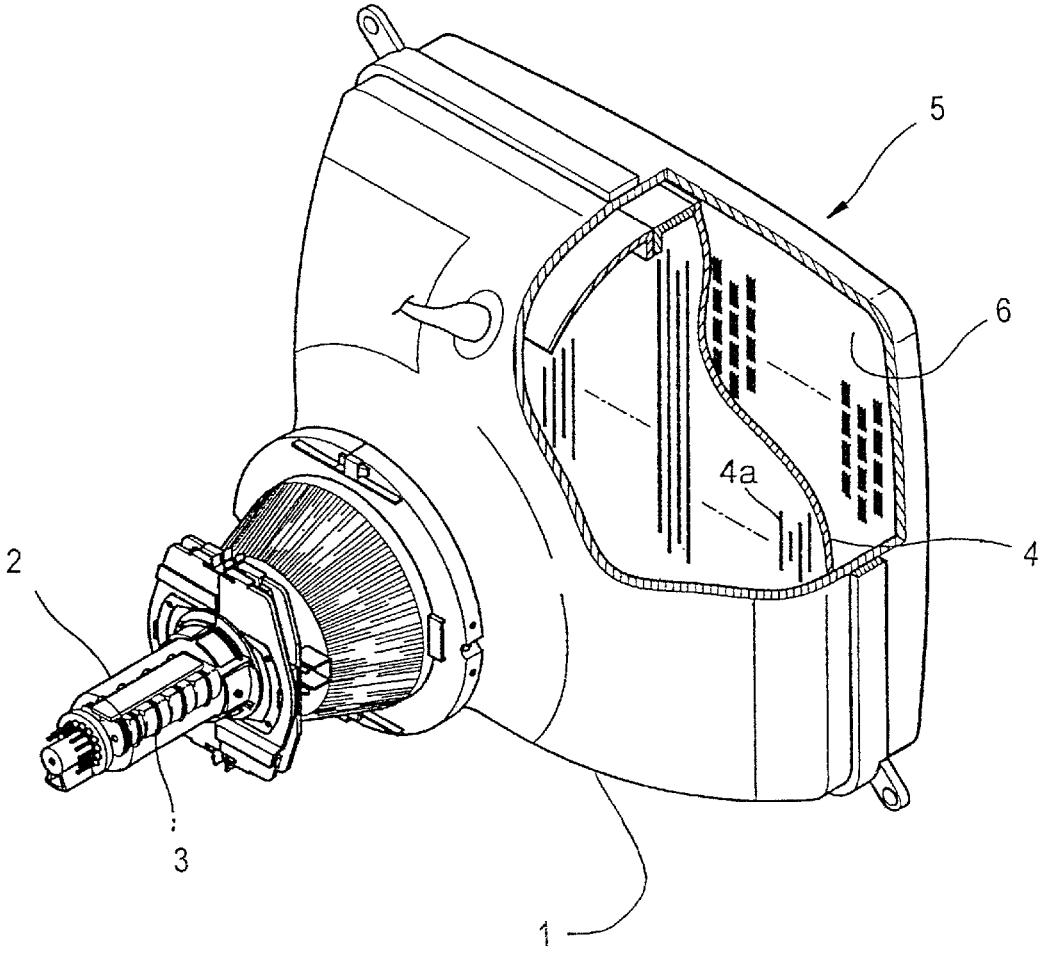
FIG. 1 is a partially cut-away perspective view showing a cathode-ray tube.

Turning now to the drawings, in a color cathode-ray tube as shown in FIG. 1, three electron beams emitted from an electron gun 3 which is installed at a neck portion 2 of a funnel 1 pass electron beams through passing holes 4*a* of a shadow mask 4 having a color selection function. Then, the beams land on a fluorescent film 6 formed on the inner surface of a panel 5 which is coupled to the funnel 1 forming a seal. The fluorescent film 6 is coated with red, green and blue fluorescent substances and the fluorescent substances are excited by the incident beams, forming an image.

The above color cathode-ray tube needs to have a flat screen surface so that a viewing angle for a viewer can be wider and distortion of an image can be prevented. Accordingly, the mask installed inside the cathode-ray tube and having a color selection function should have a flat surface. However, such a flat mask is one of many obstacles in manufacturing a complete flat cathode-ray tube.

Figure 2:
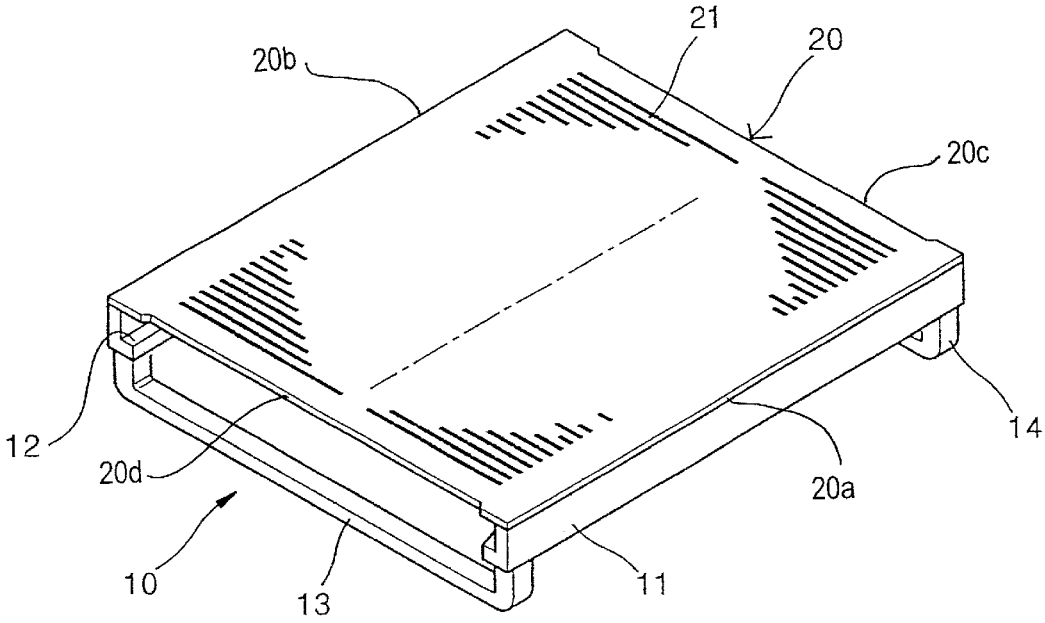
FIG. 2 is a perspective view showing a conventional tension mask frame assembly.
Figure 3:
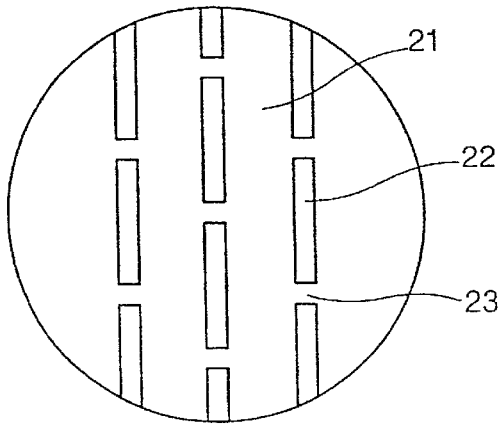
FIG. 3 is a plan view showing a portion of the tension mask shown in FIG. 2.

FIGS. 2 and 3 show an example of a tension mask frame assembly for a flat cathode-ray tube. As shown in the drawings, a tension mask frame assembly includes a frame 10 and a flat type tension mask 20. The frame 10 has first and second support members 11 and 12 installed parallel to each other, and first and second elastic members 13 and 14 separated a predetermined distance from each other and are for maintaining the support members 11 and 12. End portions of each of the first and second elastic members 13 and 14 being secured to end portions of the support members 11 and 12 at one side. The flat type tension mask 20 is welded to the supported member 11 and 12 at its corresponding edges, that is, at its longer sides 20*a* and 20*b*, so that tension is applied to the support members 11 and 12, respectively. A plurality of slits 22 are separated by strips 21 a predetermined distance from one another on the tension mask 20. The slits 22 formed by the strips 21 of the tension mask 20 are divided by tie bars 23 connecting the neighboring strips 21.

In the tension mask frame assembly having the above structure, since only the longer sides 20*a* and 20*b* of the tension mask are secured to the first and second support members 11 and 12, the shorter sides 20*c* and 20*d* of the tension mask 20 are free to vibrate in directions perpendicular to the surfaces of the tension mask 20. Thus, even a small impact applied from the outside can vibrate the tension mask 20 supported by the frame 10. Such vibrations of the tension mask 20 prohibit electron beams emitted from an electron gun 3 from accurately passing through the slits 22. Accordingly, the paths of the electron beams having passed through the slits 22 change so that an error in landing on each of portions of a fluorescent film 6 is generated. As a result, an image displayed on a screen (not shown) of the cathode-ray tube vibrates according to the vibrations of the tension mask 20 so that the quality of the image deteriorates.

Figure 4:
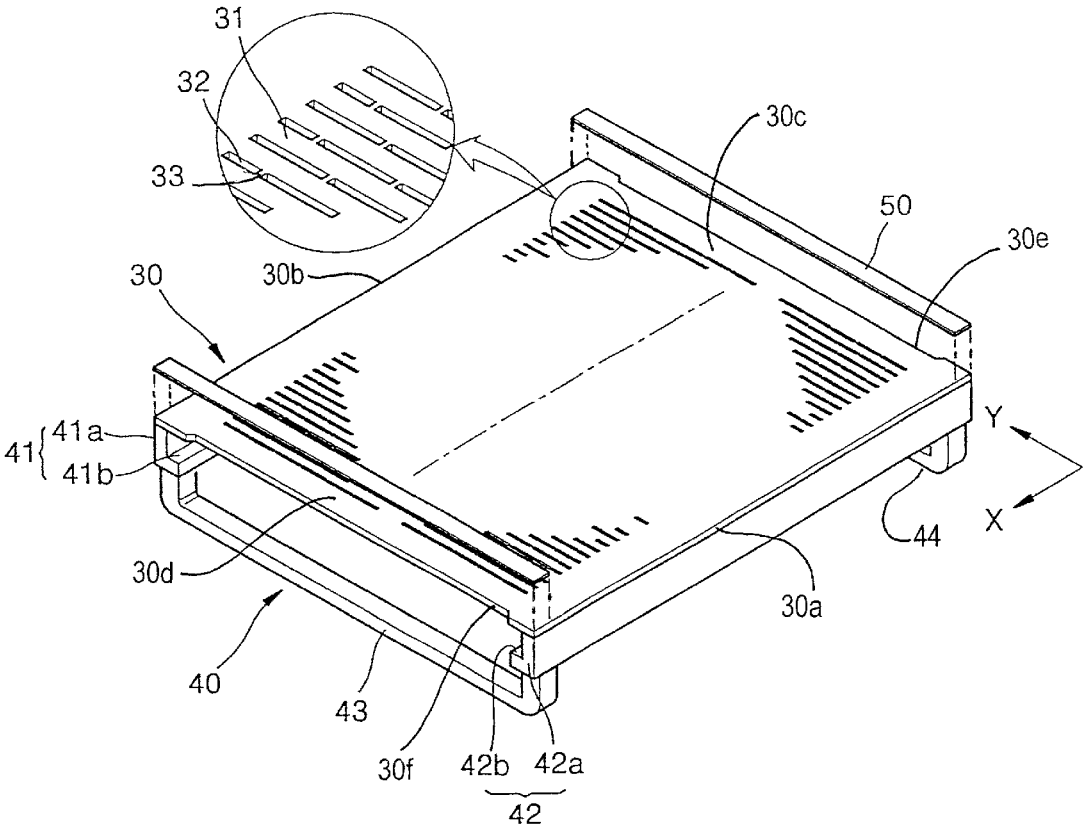
FIG. 4 is a perspective view showing a tension mask frame assembly according to a preferred embodiment of the present invention.
Figure 5:
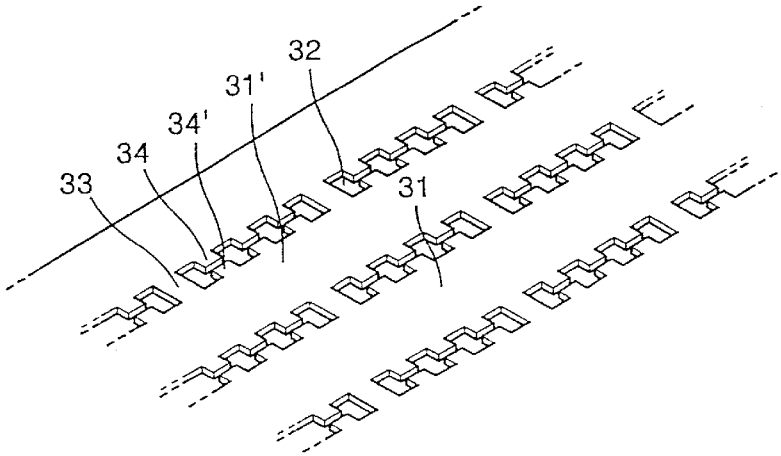
FIG. 5 is a perspective view showing the tension mask of FIG. 4.

Referring to FIGS. 4 and 5, a tension mask frame assembly according to a preferred embodiment of the present invention includes a tension mask 30 having a plurality of slits 32 through which electron beams pass, a frame 40 for supporting the tension mask 30 so that the tension mask 30 can receive a uniform tensile force in one direction (hereinafter referred to as "Y direction"), and vibration prevention members 50 supported at the frame 40 and in contact with shorter side portions 30*c* and 30*d* of the tension mask 30 for preventing vibrations of the tension mask 30.

The frame 40 includes first and second support members 41 and 42 separated a predetermined distance from each other, and a pair of first and second elastic members 43 and 44 having end portions supported by end portions of the first and second support members 41 and 42. The first and second support members 41 and 42 respectively have secured portions 41*a* and 42*a* and flange portions 41*b* and 42*b* extending from the lower portions of the secured portions 41*a* and 42*a* inwardly towards each other, so that the profile of each of the first and second support member 41 and 42 has an L-shape.

Each of the first and second elastic members 43 and 44 has a rectangular U-shape. Each end of the first and second elastic members 43 and 44 has an L-shape profile so that both end portions of the first and second elastic members 43 and 44 can be coupled to, and support, end portions of the first and second support members 41 and 42.

Although the frame 40 having the first and second support members 41 and 42 and the first and second elastic members 43 and 44 supporting the first and second support members 41 and 42 has been described, the structure of the frame 40 is not limited thereto and any structures which can apply a tensile force to the tension mask 30 in the Y-direction may be adopted. Alternatively, the first and second elastic members 43 and 44 supporting the first and second support members 41 and 42 may have both end portions thereof secured to the end portions of the first and second support members 41 and 42 at the positions inwardly spaced apart a predetermined distance in order to make the tensile force applied to the tension mask 30 uniform.

The longer sides 30*a* and 30*b* of the tension mask 30 are secured to the first and second secured portions 41*a* and 42*a*, respectively, of the frame 40 having the above structure. The tension mask 30 is manufactured by etching a thin plate. A plurality of strips 31 are formed on the tension mask 30 to be separated a predetermined distance from one another, so that slits 32 are formed. Electron beams pass through the slits 32. Stated another way, strips 31 are divided by the slits 32 disposed between the strips 31. Tie bars 33 are installed between the neighboring strips 31 to connect the neighboring strips 31, so that the slits 32 are divided.

Referring to FIG. 5, dummy bridges 34 and 34' extending from the corresponding directions of the neighboring strips 31 and 31' are formed at each of the divided slits 32. Preferably, the end portions of the corresponding dummy bridges 34 and 34' do not contact each other, and the sum of the areas of the dummy bridges 34 and 34' is equal to the areas of the tie bars 33 or the difference therebetween should be within a predetermined range.

Both end portions of each of the vibration prevention members 50 are supported at the secured portions 41*a* and 42*a* of the first and second support members 41 and 42 constituting the frame 40. The vibration prevention members 50 contact the shorter side portions 30*c* and 30*d* of the tension mask 30 to prevent vibrations of the tension mask 30. Preferred embodiments of the vibration prevention members 50 are shown in FIGS. 4, and 6 through 10.

As shown in the drawings, the vibration prevention members 50 are formed of bands having a predetermined width and thickness. Both end portions of the vibration prevention members 50 are welded at the first and second secured portions 41*a* and 42*a* where tension mask 30 is welded. Here, assuming that the length of the band is l, a tensile force applied to the band is T, mass of the band per unit length is m, the natural frequency of the band, $f_b$ is proportional to $(T/m)^{1/2}/l$. The following formula would best show the relationship:

$$f_b \; 1/(l\sqrt{(T/m)})$$

Also, assuming that the natural frequency in a lengthwise direction at the shorter side edge portion 30*c* and 30*d* of the tension mask 30 is $f_m$, when the difference between the two natural frequencies is over a predetermined value, vibrations generated due to an impact from the outside are sharply attenuated by interference therebetween. The shorter side edge portions 30*c* and 30*d* are portions of the tension mask that have no slits or holes 32 and have particular widths that border the shorter side edges 30*e* and 30*f*.

Figure 6:
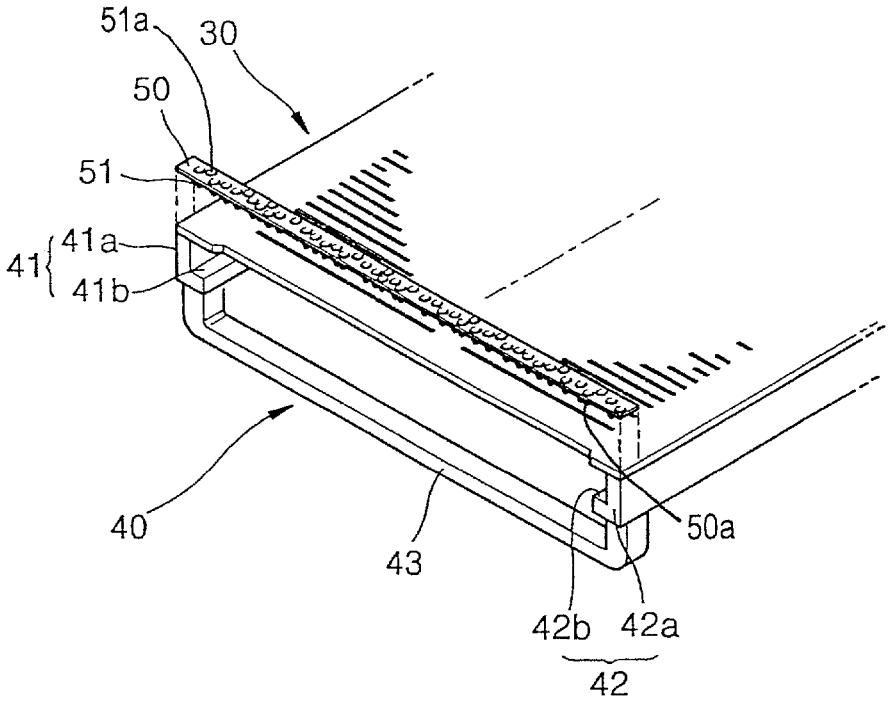
FIGS. 6 is a perspective view showing vibration prevention members according to another preferred embodiment of the present invention.

The vibration prevention members 50 formed of the band has a contact portion for improving a contact force between the shorter side edge portions 30*c* and 30*d* of the tension mask 30 and the vibration prevention members 50. Referring to FIG. 6, the contact members are a plurality of protrusions 51 formed at the band type vibration prevention members 50 to direct the longer side edge portion 50*a* of the vibration prevention members 50 in a direction corresponding to the shorter side edges 30*e* and 30*f* of the tension mask 30. An indentation 51*a* on the top side of the vibration prevention members 50 forms the protrusions 51 on the bottom side of the vibration prevention members 50.

Figure 7:
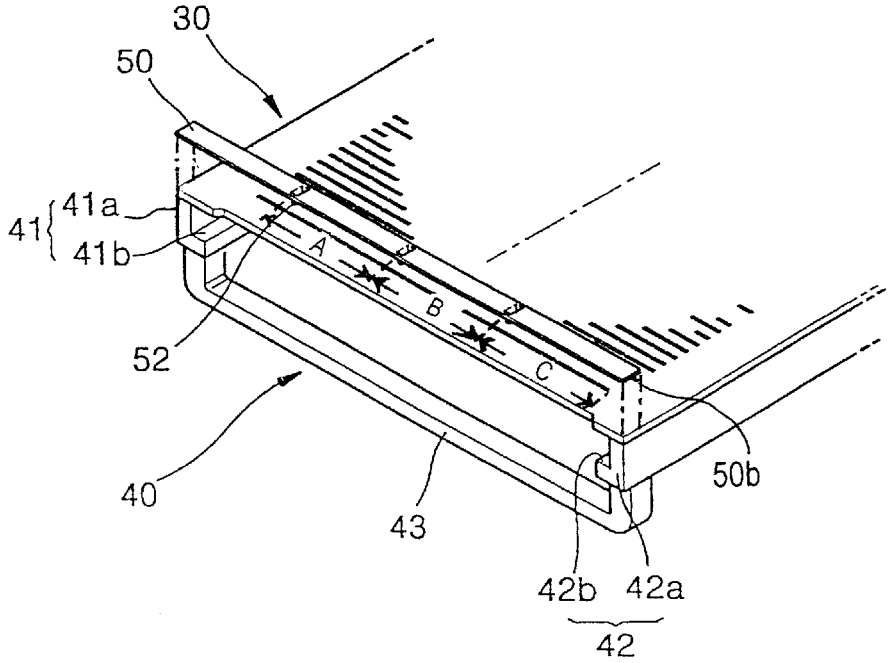
FIG. 7 is a perspective view showing vibration prevention members according to another preferred embodiment of the present invention.
Figure 8:
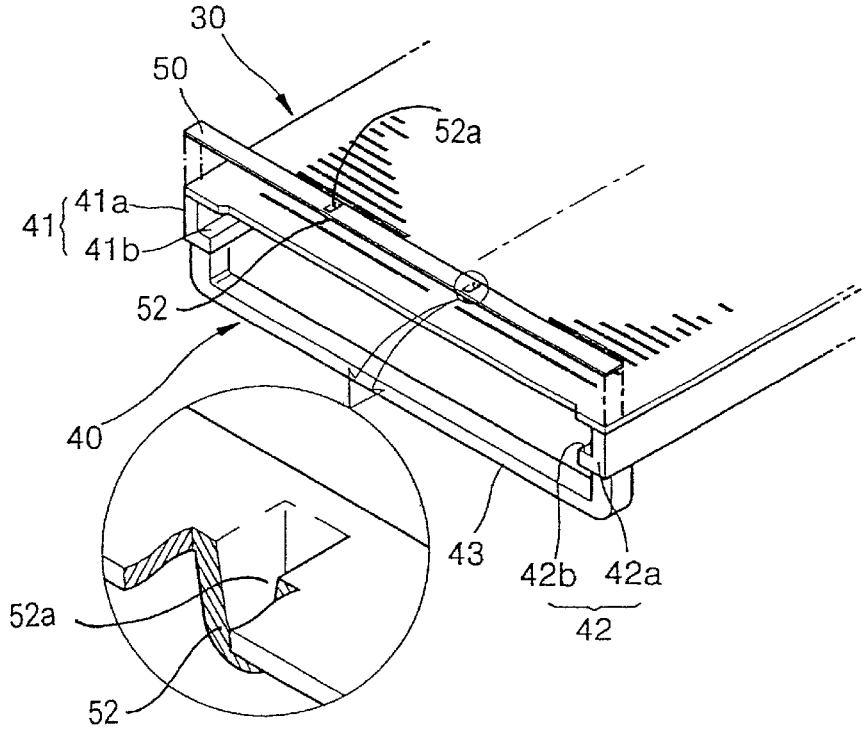
FIG. 8 is a perspective view showing a tension mask frame assembly according to another preferred embodiment of the present invention.

As seen in FIG. 7, in another preferred embodiment of the contact portion formed at the vibration prevention members 50 are formed of beads 52 which are beading-processed in a direction perpendicular to the lengthwise direction of the vibration prevention members 50 and maintained at a predetermined interval from a shorter edge 50*b* of the vibration prevention members 50. An indentation 52*a* on one side of the vibration prevention members 50 shape the beads 52 on the other side of the vibration prevention members 50. Along the length of the vibration prevention members 50, a distance between one bead 52 and an adjacent second bead 52 is A. The distance between the second bead 52 and an adjacent third bead 52 is B. The distance between the third bead 52 and a short edge 50*b* of the vibration prevention member 50 is C. Since the beads 52 are maintained at a predetermined interval on the vibration prevention members 50, then the distances are all approximately equal to each other, where A=B=C or at least distance A is approximately equal to distance B. Looking at FIG. 8, a close-up view of beads 52 can be seen. FIG. 8 shows the beads with a different interval than the beads shown in FIG. 7.

Figure 9:
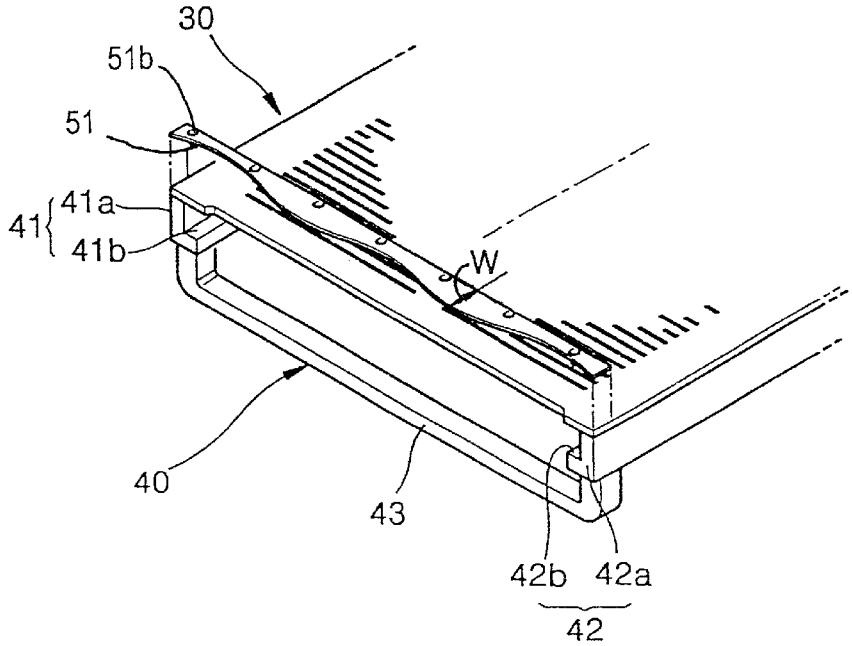
FIG. 9 is a perspective view showing a tension mask frame assembly according to yet another preferred embodiment of the present invention.

The vibration prevention members 50 may have an uneven width W, as shown in FIG. 9, to prevent vibrations. In FIG. 9, a plurality of contact members 51 contacting the tension mask 30 is preferably installed at this vibration prevention members 50 having an uneven width. The contact members 51 may for example include protrusions 51 on the bottom side of the vibration prevention members 50. Each protrusion 51 has an indentation portion 51*a* on the top side of the vibration prevention members 50. The contact members 51 can also be bead shaped or any other type of contact portion.

Figure 10:
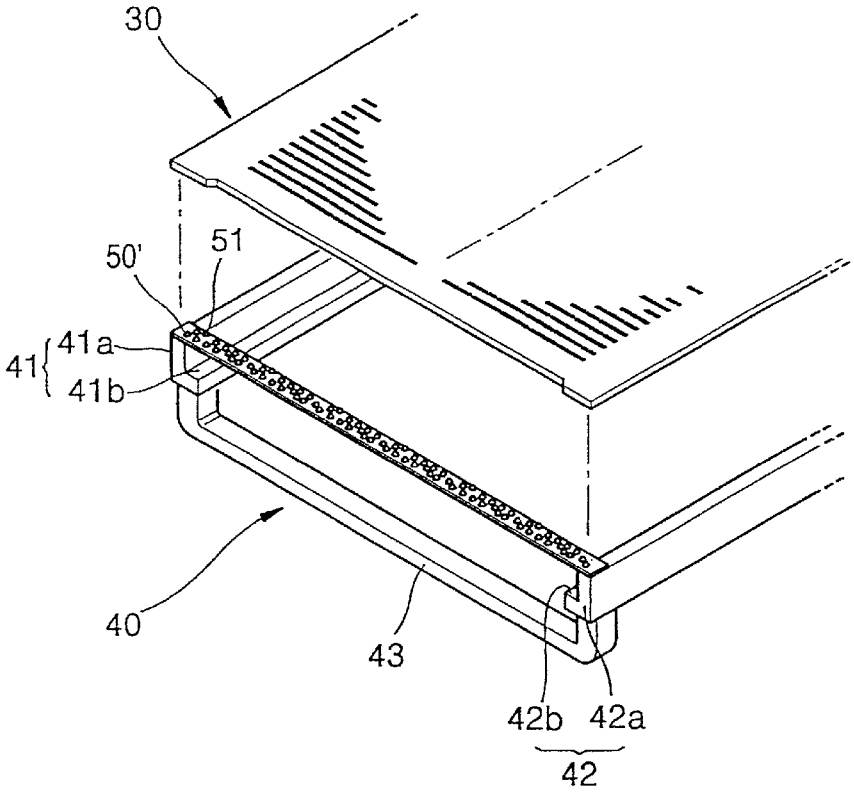
FIG. 10 is a perspective view showing a tension mask frame assembly according to another preferred embodiment of the present invention.

FIG. 10 shows a tension mask frame assembly according to yet another preferred embodiment of the present invention. In the tension mask frame assembly, both end portions of the vibration prevention members 50' are welded at the frame 40 before the tension mask 30 is welded at the frame 40, so that the vibration prevention members 50' can be located under the bottom surface of the tension mask 30.

Figure 11:
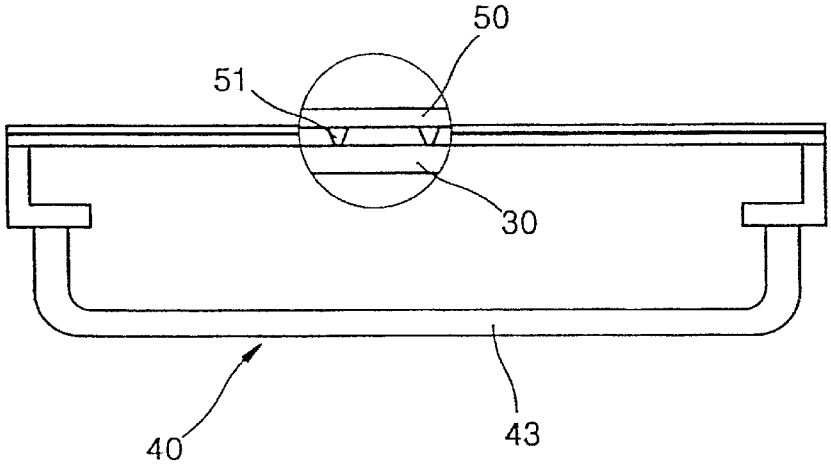
FIG. 11 is a view showing a state in which vibrations at the edge of the tension mask are prevented by the vibration prevention member according to the present invention.

The operation of the tension mask frame assembly for a color cathode-ray tube having the above structure according to the present invention is described below. As seen in FIG. 11, vibrations at the edge of the tension mask 30 are prevented by the vibration prevention member 50 as the contact members such as protrusions 51 contact the tension mask 30.

In the tension mask frame assembly, when the first and second support members 41 and 42 press each other in the opposite direction so that the first and second elastic members 43 and 44 supporting the first and second support members 41 and 42 are elastically deformed, since the longer side portions of the tension mask 30 are welded at the secured portions 41*a* and 42*a* of the first and second support members 41 and 42, a tensile force is applied to the tension mask 30 in the lengthwise direction of the strips 31.

Since the shorter side portions 30*c* and 30*d* of the tension mask 30 to which the tensile force is applied are not supported at the frame 40, the tension mask 30 is easily vibrated by a small impact applied from the outside of the tension mask 30. The vibrations are transferred not only in the lengthwise direction of the strips 31 (Y direction) but also in the widthwise direction of the strips 31 (X direction) due to the existence of the tie bars 33. When the center portion of a screen slightly vibrates, vibrations of an image are small since the vibrations are generated in the same direction as the proceeding direction of the electron beams. However, at the periphery portion of the screen, vibrations of an image is large since the incident angles of the electron beams increase.

Since the edge of the tension mask 30 is in contact with the vibration prevention members 50 of which both end portions are secured to the first and second support members 41 and 42, vibrations at the edge of the tension mask 30 can be rapidly attenuated. Such attenuation of vibrations is transferred to the center portion of the tension mask 30 through the tie bars 33.

In detail, since the edge of the tension mask 30 and the vibration prevention members 50 are supported at the first and second support members 41 and 42 to have different tensile forces, frequencies in resonance vibrations due to an impact applied from the outside become different. Since the edge of the tension mask 30 and the vibration prevention members 50 are in contact with each other, vibrations at the periphery of the tension mask 30 are attenuated by being interfered with vibrations of the vibration prevention members 50.

In particular, since the contact portion for the contact with the edge of the tension mask 30 is provided to the vibration prevention members 50, the above-mentioned vibrations attenuation effect can be improved. For example, as shown in FIG. 7, when the beads 52 are formed at a predetermined interval at the vibration prevention members 50, since the period of vibrations at the periphery of the tension mask 30 is limited to the interval of the beads 52, a dampening effect can be improved.

As described above, in the tension mask frame assembly for a flat type cathode-ray tube according to the present invention, since the vibration prevention members are installed at the edge of the first and second support members contacting the edge of the tension mask, vibrations of the tension mask can be prevented and furthermore vibrations of an image due to the vibrations of the tension mask can be prevented.

It is noted that the present invention is not limited to the preferred embodiment described above, and it is apparent that variations and modifications by those skilled in the art can be effected within the spirit and scope of the present invention defined in the appended claims.

What is claimed is:

1. An apparatus, comprising:

a frame including first and second support members separated a predetermined distance from each other, and at least a pair of elastic members for supporting the first and second support members, both end portions of each of the elastic members being secured to the first and second support members;

a tension mask of a color cathode-ray tube including a plurality of strips separated a predetermined distance from each other and forming slits, the slits allowing electron beams to pass through, a plurality of tie bars disposed between the strips and connecting neighboring strips to divide slits, longer side portions of the tension mask being perpendicular to a lengthwise direction of the strips being secured to the first and second support members accommodating a tensile force applied to the strips; and vibration prevention members having both end portions supported at the first and second support members, having a predetermined tensile force, and being in contact with shorter side portions of the tension mask in a direction parallel to the strips of the tension mask.

2. The apparatus of claim 1, with the vibration prevention members being formed of bands, the bands having a plurality of contact members facilitating contact with the edge of the shorter side portions of the tension mask.

3. The apparatus of claim 2, with the contact members being formed at the vibration prevention members, the contact members being a plurality of protrusions contacting the edge of the tension mask.

4. The apparatus of claim 2, with the contact members being formed of a plurality of beads formed perpendicular to a lengthwise direction of the vibration prevention members.

5. The apparatus of claim 1, with the vibration prevention members being located between a bottom surface of the tension mask and a top surface of the first and second support members.

6. The apparatus of claim 5, with the vibration prevention members having a plurality of contact members, the contact members being a plurality of protrusions contacting the edge of the tension mask.

7. The apparatus of claim 1, with the vibration prevention members having contact members being formed of a plurality of beads formed perpendicular to a lengthwise direction of the vibration prevention members, the beads being formed at a predetermined interval along the length of the vibration prevention members.

8. The apparatus of claim 1, with the vibration prevention members being in contact with an edge of the shorter side of the tension mask and in contact with a portion of the tension mask not having any slits.

9. An apparatus, comprising:

a frame including first and second support members separated a predetermined distance from each other, and at least a pair of elastic members for supporting the first and second support members, both end portions of each of the elastic members being secured to the first and second support members;

a tension mask of a color cathode-ray tube including a plurality of strips separated a predetermined distance from each other and forming slits, the slits allowing electron beams to pass through, a plurality of tie bars disposed between the strips and connecting neighboring strips to divide slits, longer side portions of the tension mask being perpendicular to a lengthwise direction of the strips being secured to the first and second support members accommodating a tensile force applied to the strips; and vibration prevention members having both end portions supported at the first and second support members, having a predetermined tensile force, and being in contact with shorter side portions of the tension mask in a direction parallel to the strips of the tension mask, with the vibration prevention members having an uneven width along a length of the vibration prevention members.

10. The apparatus of claim 9, with the vibration prevention members having a plurality of contact members facilitating contact with the edge of the shorter side portions of the tension mask.

11. An apparatus, comprising:

a frame including first and second support members separated a predetermined distance from each other, and at least a pair of elastic members for supporting the first and second support members, both end portions of each of the elastic members being secured to the first and second support members;

a tension mask of a color cathode-ray tube including a plurality of strips separated a predetermined distance from each other and forming slits, the slits allowing electron beams to pass through, a plurality of tie bars disposed between the strips and connecting neighboring strips to divide slits, longer side portions of the tension mask being perpendicular to a lengthwise direction of the strips being secured to the first and second support members accommodating a tensile force applied to the strips; and vibration prevention members having both end portions supported at the first and second support members, having a predetermined tensile force, and being in contact with shorter side portions of the tension mask in a direction parallel to the strips of the tension mask, with the slits of the tension mask having a first and second bridges, the first and second bridges not allowing electron beams to pass through, the first and second bridges extending toward each other but not touching each other, a gap being formed between the ends of the first and second bridges.

12. An apparatus, comprising:

a frame including first and second support members separated a predetermined distance from each other, and at least a pair of elastic members for supporting the first and second support members, both end portions of each of the elastic members being secured to the first and second support members;

a tension mask of a color cathode-ray tube including a plurality of strips separated a predetermined distance from each other and forming slits, the slits allowing electron beams to pass through, a plurality of tie bars disposed between the strips and connecting neighboring strips to divide slits, longer side portions of the tension mask being perpendicular to a lengthwise direction of the strips being secured to the first and second support members accommodating a tensile force applied to the strips; and vibration prevention members having both end portions supported at the first and second support members, having a predetermined tensile force, and being in contact with shorter side portions of the tension mask in a direction parallel to the strips of the tension mask, with the vibration prevention members having contact members being formed of a plurality of beads formed perpendicular to a lengthwise direction of the vibration prevention members, the beads being formed at a predetermined interval along the length of the vibration prevention members, with the beads having a long side perpendicular to the lengthwise direction of the vibration prevention members, the beads having an indentation on one side of the vibration prevention members forming the boundary of the bead protruding through to an opposite side of the vibration prevention members.

13. An apparatus, comprising:

a frame;

a tension mask of a cathode-ray tube supported by the frame, the tension mask including a plurality of strips divided by a plurality of slits, the slits allowing electron beams to pass through, the strips formed parallel with a shorter side portion of the tension mask, the tension mask accommodating a tensile force applied to the strips; and a plate having both end portions supported by the frame, the plate having a predetermined tensile force, the plate being in contact with the shorter side portion of the tension mask in a direction parallel to the strips of the tension mask, the plate contacting the length of the shorter side portion.

14. The apparatus of claim 13, with the plate having a plurality of protrusions contacting an edge of the tension mask.

15. The apparatus of claim 13, with the plate having a plurality of beads formed with a long side perpendicular to a lengthwise direction of the plate, the beads being formed at predetermined intervals along the length of the plate.

16. The apparatus of claim 13, with the plate being located between a bottom surface of the tension mask and a top surface of the frame, the plate having a plurality of contact members, the contact members being a plurality of protrusions contacting the edge of the tension mask.

17. The apparatus of claim 13, with the plate being on a top surface of the tension mask, the plate having a plurality of contact members in contact with the shorter side portion of the tension mask, a bottom side of the tension mask being supported by the frame.

18. An apparatus, comprising:

a frame;

a tension mask of a cathode-ray tube supported by the frame, the tension mask including a plurality of strips divided by a plurality of slits, the slits allowing electron beams to pass through, the strips formed parallel with a shorter side portion of the tension mask, the tension mask accommodating a tensile force applied to the strips; and a plate having both end portions supported by the frame, the plate having a predetermined tensile force, the plate being in contact with the shorter side portion of the tension mask in a direction parallel to the strips of the tension mask, the plate contacting the length of the shorter side portion, with the plate having a varying width along the length of the plate.

19. The apparatus of claim 18, with the plate having a plurality of contact members facilitating contact with the edge of the shorter side portions of the tension mask.

* * * * *